United States Patent [19]

Markwood

[11] 4,165,012

[45] Aug. 21, 1979

[54] FILLER FOR PRESSURE VESSEL

[75] Inventor: Robert E. Markwood, Chester, Va.

[73] Assignee: Philip Morris Incorporated, New York, N.Y.

[21] Appl. No.: 858,230

[22] Filed: Dec. 7, 1977

[51] Int. Cl.[2] ..... B65D 7/42

[52] U.S. Cl. ..... 220/71; 220/3

[58] Field of Search ..... 220/71, 66, 68, 85 R, 220/88 R, 3

[56] References Cited

U.S. PATENT DOCUMENTS

| | | | |
|---|---|---|---|
| 2,120,057 | 6/1938 | Merrill | 220/3 X |
| 2,144,945 | 1/1939 | Sutton | 220/71 |
| 2,223,313 | 11/1940 | Collins | 220/3 X |
| 2,844,939 | 7/1958 | Schultz | 220/3 X |
| 3,338,238 | 8/1967 | Warncke | 220/3 X |

*Primary Examiner*—William Price
*Assistant Examiner*—Steven M. Pollard
*Attorney, Agent, or Firm*—Arthur I. Palmer, Jr.; George E. Inskeep; Susan A. Hutcheson

[57] ABSTRACT

In a pressure vessel having domed ends concave to the pressure, in certain situations, the space within the domes is undesirable. One or both ends may be equipped with space-filling inserts comprising multiple plates of aluminum or other light metal secured in slightly spaced parallel relationship.

6 Claims, 5 Drawing Figures

FILLER FOR PRESSURE VESSEL

BACKGROUND OF THE INVENTION

Cylindrical pressure vessels are commonly equipped with domed ends or heads. Such construction gives strength; it facilitates radiographic inspection of welds; and for vessels used in upright position, it provides for thorough emptying of liquid contents. When a vessel is so positioned, however, the space within one or both of the curved end portions may be unusable. Such a situation is encountered when a charge of solid material to be treated is placed in the vessel in an open-work container such as a wire basket for subsequent immersion in a liquid under pressure. The quantity of liquid or compressed gas required to fill the vessel and to be later recovered or discarded is then unnecessarily large.

The waste space could be filled by a hollow metal shape or a solid casting formed to occupy the end portion. The former would undergo great stress during pressure changes in the vessel and be subject to failure after prolonged use, if not initially. The latter would be costly to make and might be found to have internal voids. Concrete has been used, but it gives expansion problems and adds excessive weight.

SUMMARY OF THE INVENTION

The present inventor has solved the problem with a structure of metal plates secured together in parallel arrangement and with narrow spacing between adjacent plates to facilitate draining and to avoid inadvertant interior gaps which might result from a face-to-face laminar structure. The metal must be one which can withstand exposure to the contents of the vessel and preferably is one that is of low density, such as aluminum or magnesium. Steel could be used if required by the environment.

The plates are fixed by any conventional means such as bolt rods on which washers are interposed to maintain the desired spacing. Spacing from the vessel head interior is also desirable to facilitate draining.

Detailed Description

A set of circular plates, from ½ to 2 inches less in diameter than the inner diameter of the vessel head at the position each is to occupy, is provided with three or more bolt holes symmetrically located to accommodate bolt rods previously attached to the head parallel to the axis of the vessel. The size of the holes permits slipping the plates over the rods. The plates are, for example, of aluminum 2 to 4 inches thick and occupy substantially all of the end space in the vessel not required for its charge and container. The plates are stacked on the bolt rods with washers of about ⅛ inch in thickness separating each two and are secured with nuts. Optionally, the edges of the plates may be contoured to match the adjacent head, and the centers of the plates may be cut out to facilitate admission or removal of treating liquid. This may be further aided by an inclined surface on each plate.

Alternatively, the plates may be cut as, approximately, segments of circles and positioned parallel to the vessel's long axis, slightly spaced as above, the flat sides of the segments presenting a flat overall grating-like surface toward the working space in the vessel.

Other unused interior spaces in a pressure vessel may be filled in the same way. Longitudinal space along the cylindrical wall, for example, can be filled to provide a flat floor in a horizontally-disposed cylindrical vessel or to leave a working space of square or rectangular cross section. Preferably in these cases the plates would be aligned longitudinally of the cylinder and at right angles to the flat floor or wall. Possibly circular segment shapes would be employed, transverse to the long axis.

Other conventional methods of securing the plates may, of course, take the place of bolting, with means to maintain the spaced relationship.

DESCRIPTION OF THE DRAWINGS

Like numbers in all drawings are used to refer to like parts. The fillers are, in all instances, spaced slightly from the vessel head 11 or wall 12. Filler plates 13 are spaced slightly from each other by means of washers 14 and are supported on the adjacent head or wall by means of bolt rods 15.

FIG. 1 illustrates a preferred form of the invention wherein a movable head 11 for a pressure vessel (which is a cylinder in upright position) is equipped with a filler assembly. Plates 13 are separated by ⅛-inch washers 14 and secured to the interior of the head by bolt rods 15. A central port to facilitate filling and drainage is provided by holes 17 machined in the plates.

FIG. 2 shows the use of the invention to provide a flat floor along a curved side 12 of a horizontally-disposed vessel. The plates 13 in this embodiment are held by support rods 16 that are attached to bolt rods 15 and spaced by washers 14 (FIG. 3).

A similar disposition of filler plates in FIG. 4 encloses four sides of a work space in a cylindrical vessel, which may be either horizontally or vertically placed. FIG. 5 illustrates a filler floor similar to that of FIGS. 2 and 3 but with transverse plates 13 supported by longitudinal rods 16.

Figure 1:
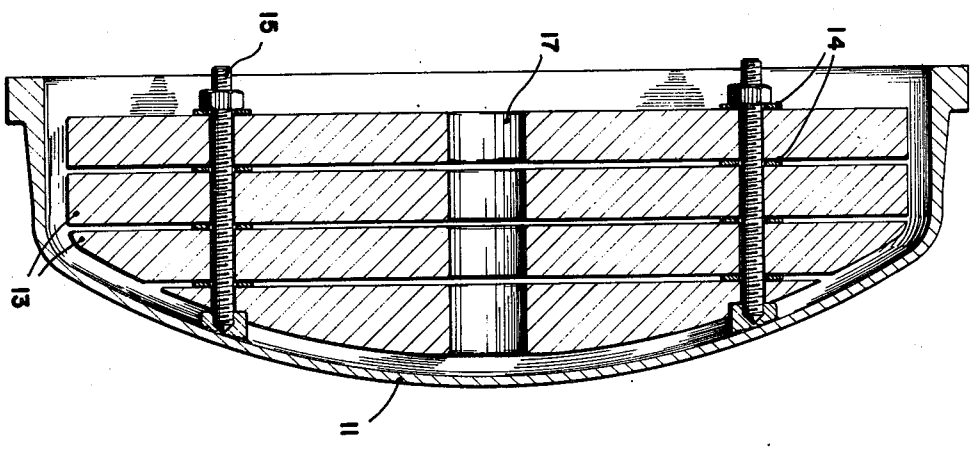
FIG. 1 is a cross section of a pressure vessel domed head provided with the filler construction of the invention.
Figure 2:
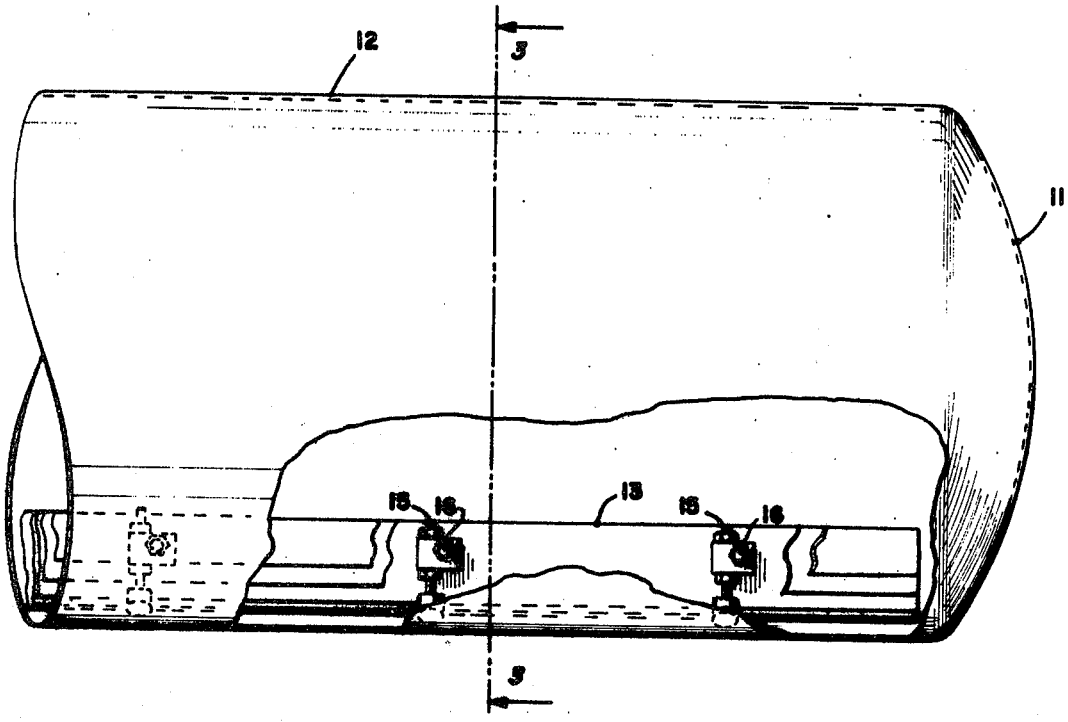
FIG. 2 is a profile view, partially broken away, of a horizontally disposed pressure vessel having a filler floor.
Figure 3:
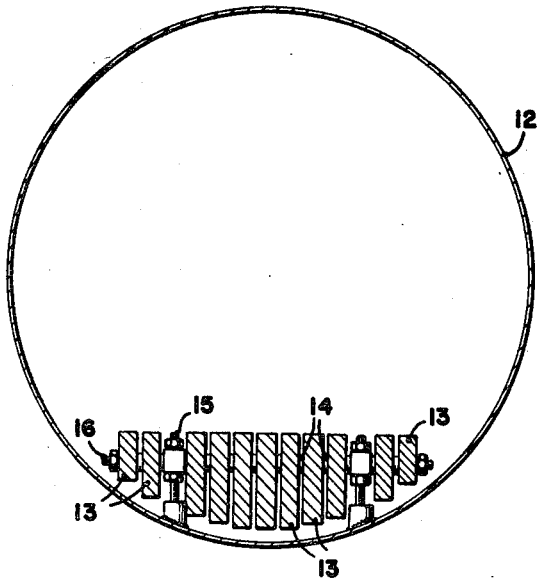
FIG. 3 is a sectional view (of the same vessel) taken along the line 3—3 of FIG. 2.
Figure 5:
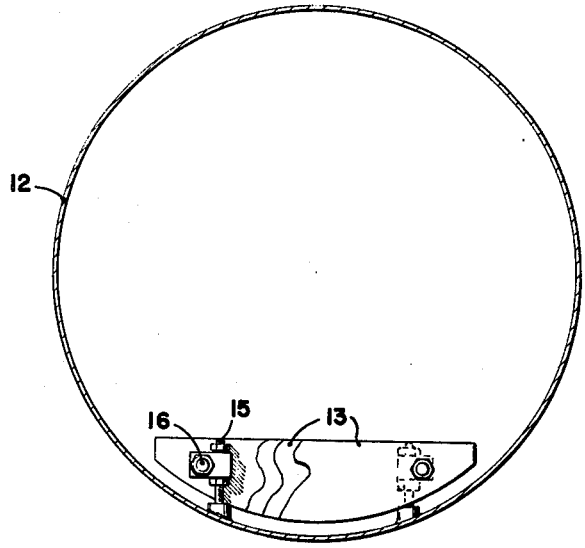
FIG. 5 is a sectional view of a like vessel having a filler floor of transverse plates partially broken away for this view.
Figure 4:
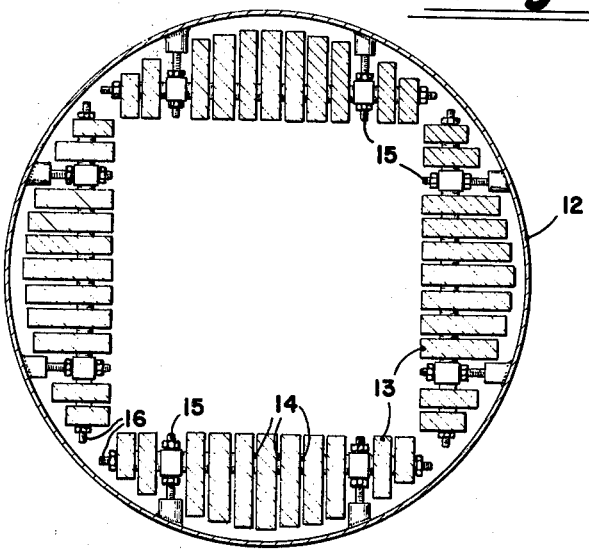
FIG. 4 is a sectional view of a like vessel having fillers along four sides.

What is claimed is:

1. In a vessel for holding fluid under pressure, having an interior working space and having an exterior wall of the vessel defining a curved surface, an assembly for filling an interior portion of the vessel adjacent said surface, comprising a plurality of individual metal plates stacked together in parallel, slightly spaced relationship, said plates being relatively thicker than the spaces between them so as to occupy substantially all of said interior portion in which they are located thereby reducing the volume of fluid needed to fill the working space of said vessel.

2. An assembly according to claim 1, said vessel having a domed head at one end thereof, wherein said filler plates are disposed within the domed head.

3. An assembly according to claim 1 wherein said plates are supported from the adjacent wall of said vessel in spaced relation to the curved surface thereof, and are held in place by at least one bolt extending through the plates.

4. An assembly according to claim 1 wherein the metal plates are aluminum.

5. An assembly according to claim 4 wherein said plates are from 2 to 4 inches in thickness.

6. An assembly according to claim 1 wherein said plates are provided with ports for the passage of a fluid.

* * * * *